US006966382B2

(12) United States Patent
Buckle et al.

(10) Patent No.: US 6,966,382 B2
(45) Date of Patent: Nov. 22, 2005

(54) SECONDARY RELEASE FOR WELLHEAD CONNECTOR

(75) Inventors: Kevin G. Buckle, Scotland (GB); Stuart F. Young, Scotland (GB)

(73) Assignee: Vetco Gray Inc., Houston, TX (US)

( * ) Notice: Subject to any disclaimer, the term of this patent is extended or adjusted under 35 U.S.C. 154(b) by 161 days.

(21) Appl. No.: 10/641,180

(22) Filed: Aug. 14, 2003

(65) Prior Publication Data

US 2005/0034870 A1 Feb. 17, 2005

(51) Int. Cl.[7] ..... E21B 29/12
(52) U.S. Cl. ..... 166/348; 166/345; 166/368
(58) Field of Search ..... 166/345, 348, 166/368; 285/920, 123.9, 123.13

(56) References Cited

U.S. PATENT DOCUMENTS 4,564,068 A * 1/1986 Baugh ..... 166/123
4,902,044 A 2/1990 Williams et al.
6,554,324 B1 * 4/2003 Herman ..... 285/322
6,557,638 B2 * 5/2003 Cunningham et al. ..... 166/348

* cited by examiner

*Primary Examiner*—William Neuder
(74) *Attorney, Agent, or Firm*—Bracewell & Giuliani, LLP

(57) ABSTRACT

In a subsea wellhead assembly, a connector attaches a production riser or subsea tree to a wellhead housing. The connector includes a piston that cams a plurality of dogs into and out of engagement with the wellhead housing while sliding axially upward and downward relative to the wellhead housing. The piston is typically actuated by injecting hydraulic fluid into either an upper chamber or lower chamber to move the piston axially up or down. While in the axially downward, or locked position, the piston houses an override chamber. Hydraulic fluid is injected into the override chamber to move the piston axially upward and unlock the connector when the seals of the lower chamber fail.

8 Claims, 5 Drawing Sheets

SECONDARY RELEASE FOR WELLHEAD CONNECTOR

BACKGROUND OF THE INVENTION

1. Field of the Invention

The present invention relates generally to wellhead assemblies, more specifically to assemblies and methods for connecting a horizontal tree to a wellhead housing.

2. Background of the Invention

Well fluid from a subsea well typically flows up a string of production tubing to a subsea wellhead. Sometimes well fluid is transmitted through a production riser to a Christmas tree on a vessel at the surface of the sea. It is often desirous however to transport the well fluid through a subsea Christmas tree to a collection facility or processing site. In either situation, the production riser or the subsea tree mounts to the wellhead housing. Typically, the production riser or subsea tree has a connector that receives an upper portion of the wellhead housing and then engages a grooved profile on the wellhead housing with a plurality of dogs.

Previously, the connector included a fluted receiving portion that receives and lands on the upper portion of the wellhead housing. The plurality of dogs align with the grooved profile on the outer surface of the wellhead housing when the connector lands on the wellhead housing. A piston housed with the connector slides axially up and down. The piston typically engages the dogs to cam the dogs, which engage the grooved profile of the wellhead housing. When the dogs are cammed radially inward, the connector and the dogs are in their locked positions. The dogs can be biased radially outward, or the dogs can be actuated radially outward upon upward movement of the piston in order to cam the dogs radially outward, or unlocked position.

The piston is actuated with hydraulic fluid that is injected into annular chambers formed around upper and lower portions of the piston with seals. When the seals function properly, hydraulic fluid is injected into an upper chamber to actuated the piston axially downward and thereby move the dogs into their locked position to engage the wellhead housing. Hydraulic fluid is injected into the lower chamber to actuate the piston axially upward to unlock the dogs from the wellhead housing.

Previously, when the seals failed so that hydraulic fluid could not build enough pressure to unlock the connector from the wellhead housing, a secondary piston assembly that was typically located external to the connector was used to lift the piston and unlock the connector. External piston assemblies are typically cumbersome and heavy, which causes the operator to take up valuable space around the subsea tree and wellhead assembly. Additionally, the parts of the connector that were engaged by the external piston had to be capable of sustaining the additional force of being pulled or pushed externally by the external piston.

SUMMARY OF THE INVENTION

In the subsea wellhead of this invention, the subsea wellhead assembly includes a connector that receives an axially upper portion of the tubular wellhead member which can be unlocked without an external piston. The connector has a plurality of locking dogs that actuate radially inward and outward between locked and unlocked positions, and a main piston housed within the connector for actuating the plurality of locking dogs with the wellhead member. The piston of the connector includes a chamber located in a lower portion of the main piston when the main piston is in its axially downward position. Hydraulic fluid can be injected into the chamber to exert an axially upward force on the main piston. The upward force on the piston from the hydraulic fluid causes the piston to move axially upward for actuating the locking dogs to the unlocked position.

The chamber can be formed with a second piston that is sealingly housed within the lower portion of the main piston when in its axially lower position. The chamber can also be formed with a bellow that is located within the axially lower portion of the piston. In either version, the hydraulic fluid increases pressure on the piston and increases the size of the chamber by forcing the piston axially upward.

DETAILED DESCRIPTION OF THE PREFERRED EMBODIMENT

Figure 1:
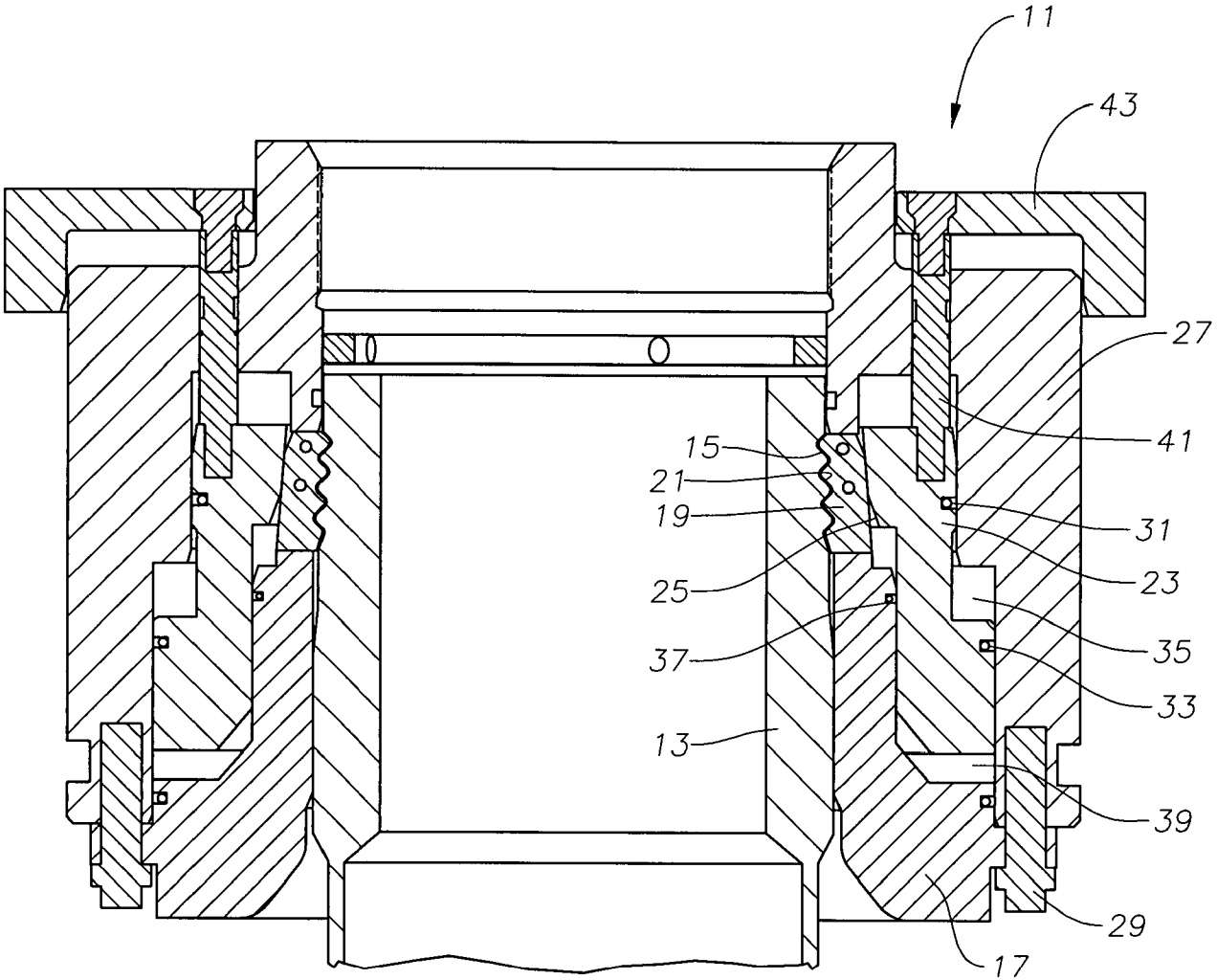
Fig. 1 (Prior Art)
FIG. 1 is an overall sectional view of an upper portion of a wellhead assembly and a connector for a horizontal tree assembly, each being constructed in accordance with the prior art.

Referring to FIG. 1, a connector assembly 11 of a horizontal tree is connected to the upper portion of a wellhead housing 13. Wellhead housing 13 has a grooved profile 15 located toward an upper portion of wellhead housing 13 for engaging connector 11. Connector 11 has a tubular receiving portion 17 located toward its lower end. Receiving portion 17 receives grooved profile 15 and the upper portion of wellhead housing 13. A plurality of dogs 19 are located axially above receiving portion 17 so that dogs align with grooved profile 15 on wellhead housing 13. Each dog 19 has a grooved profile 21 that matingly engages grooved profile 15 on wellhead housing 13.

As receiving portion 17 and dogs 19 receive the upper portion of wellhead housing 13, dogs 19 are in an unlocked position so that dogs 19 are radially outward of group profile 15. Dogs 19 cannot move axially relative to connector 11, but can move radially inward and outward for engaging and disengaging group profile 15. Connector 11 includes a piston cam 23 located radially outward from receiving portion 17 and dogs 19. An inclined face 25 is formed on an inner surface of piston 23 for engaging an outer surface of dogs 19, to thereby actuate dogs 19 between radially inward and outward positions. Piston 23 reciprocates axially upward and downward, thereby sliding inclined face 25 relative to the outer surface of dogs 19. As piston 23 and inclined face 25 slide axially downward relative to outer surface of dogs 19, inclined face 25 exerts a radially inward force on dogs 19 thereby pushing dogs 19 radially inward. When dogs 19 are pushed radially inward by piston 23, group profile 21 of dogs 19 engages grooved profile 15 of wellhead housing 13.

Hydraulic fluid actuates piston 23 axially upward and downward for engaging and disengaging connector 11 with wellhead housing 13. Piston 23 is located radially between dogs 19 and an outer casing 27 of connector 11. Outer casing 27 connects to receiving portion 17 with fasteners 29, thereby defining a piston chamber for piston 23 to slide axially upward and downward while locking and unlocking connector 11. An upper seal 31 surrounds the outer circumference of an upper portion of piston 23 and engages the inner surface of outer casing 27. A lower seal 33 located axially below upper seal 31, surrounds the outer circumference of a lower portion of piston 23. Upper seal 31 and lower seal 33 thereby defining an upper piston chamber 35. Hydraulic fluid is transmitted into upper piston chamber 35 to actuate piston 23 in an axially downward direction to cam dogs 19 into engagement with grooved profile 15 on wellhead housing 13.

Another lower seal 37, located on a radially interior surface of piston 23 engages an outer surface of receiving portion 17. Lower seals 33 and 37 defining a lower piston chamber 39, which receives hydraulic fluid to actuate piston 23 in an axially upward direction to unlock connector 11 from wellhead assembly 13.

It is essential that seals 31, 33, 37 maintain engagement with the surfaces of outer casing 27 and receiving portion 17 for upper and lower piston chambers 35 and 39 to maintain proper pressure in order to actuate piston 23 between upward and downward positions. Should one of seals 31, 33, 37 fail, it is difficult for the pressure in pressure chambers 35 and 39 to reach a preselected amount necessary to actuate piston 23 between upper and lower positions. Therefore, override rods 41 extend from a radially upward position to engage in upper portion of piston 23. Override rods 41 extend from piston 23 to an override plate 43 located above piston 23 and outer casing 27. In the event of a failure of one of seals 31, 33, 37, override plate is moved in an axially upward position to thereby pull piston 23 in an upward direction with override rods 41. Typically, override plate 43 is moved in an axially upward position with a secondary piston assembly (not shown) that is external to connector 11. Such external secondary piston assemblies in the prior art have typically been cumbersome and heavy.

Figure 2:
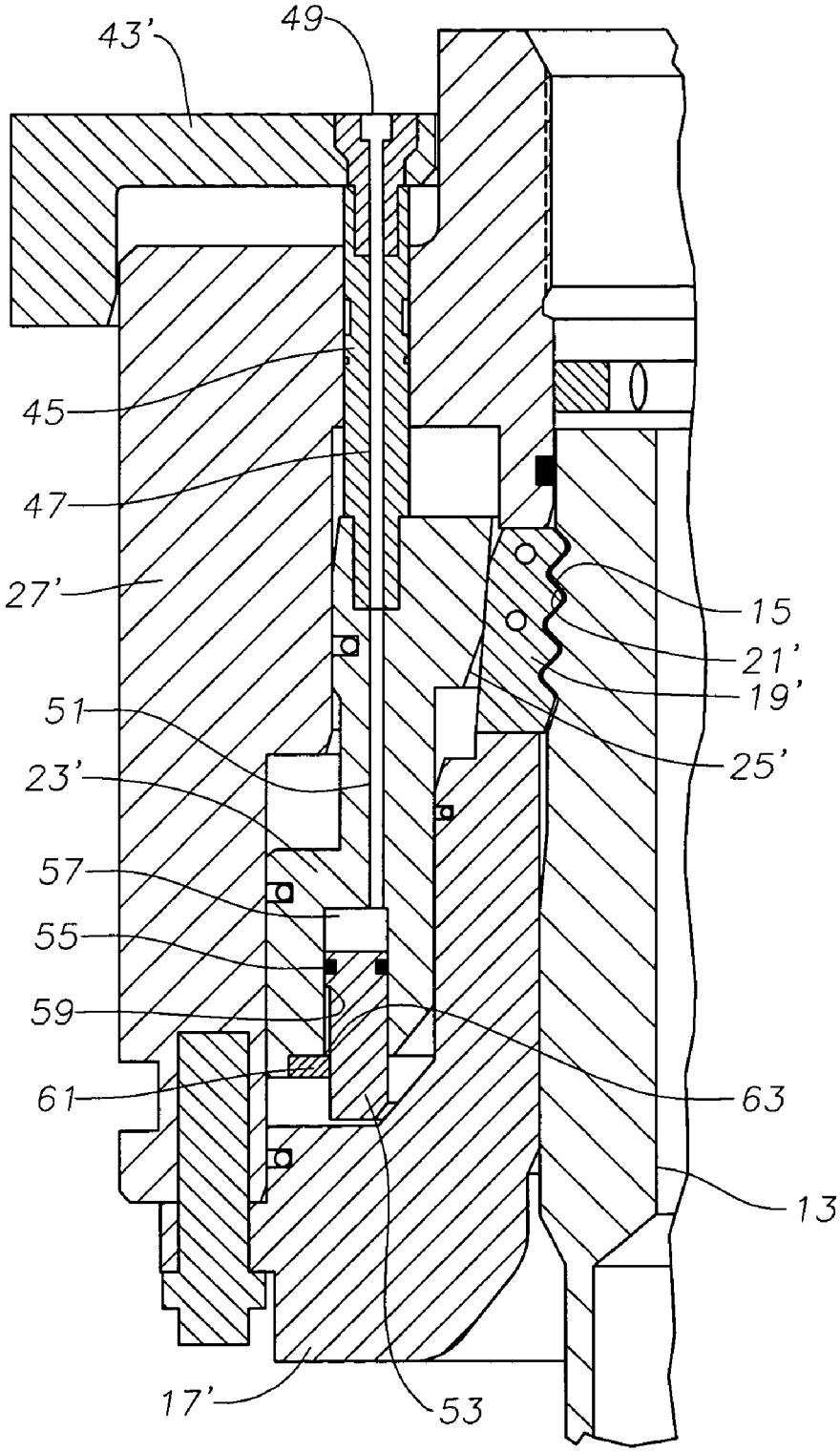
FIG. 2 is an overall sectional view of a connector assembly for a horizontal tree, being constructed in accordance with this invention.

Referring to FIG. 2, an improved connector 11' is shown attached to the upper portion of wellhead housing 13. Connector 11' includes a receiving portion 17', outer casing 27', dogs 19', and a piston 23'. While locking and unlocking under normal operating conditions, connector 11' functions essentially the same as the prior art connecter assembly 11 shown in FIG. 1. Improved connector assembly 11' includes an override rod 45. Override rod 45 extends between override plate 43' and piston 23' in substantially the same manner as override rod 41 in prior art FIG. 1. Override rod 45 preferably includes a rod passage 47 extending axially therethrough. A piping connection 49 is located toward an axially upper portion of rod passage 47. Hydraulic fluid is transmitted into rod passage 47 through piping connection 49. A piston passage 51 is ported through piston 23'. Piston passage 51 has an end that is in fluid communication with rod passage 47. A secondary piston 53 is located toward the lower end of piston 23'.

Piston passage 51 has another end that is in fluid communication with secondary piston 53 so that rod passage 47 is in fluid communication with secondary piston 53. Seals 55 located around the inner and outer circumferences of secondary piston 53 engage interior surfaces of piston 23'. Seals 55 define an override chamber 57 above secondary piston 53. Secondary piston 53 slides axially relative to piston 23' as hydraulic fluid is transmitted through rod passage 47 and piston passage 51 into override chamber 57. A lip 59 is formed on a radial exterior surface of secondary piston 53. In this embodiment lip 59 engages a shoulder 63 protruding radially inward from a mechanical guide 61 on piston 23'. Shoulder 63 prevents secondary piston 53 from sliding beyond a preselected piston stroke by engaging lip 59 when secondary piston 53 slides axially downward relative to piston 23'.

In operation connector 11' lands on wellhead housing 13 with receiving portion 17' sliding over and receiving an upper portion of wellhead housing 13 including group profile 15. Upon landing on wellhead housing 13, dogs 19 are at an axial elevation substantially equal to grooved profile 15. A hydraulic fluid is transmitted into upper piston chamber 35' in a manner known in the art to actuate piston 23' from an axial upward position to an axial downward position. While moving from the axial upward position to the downward position inclined face 25' engages the outer surface of dogs 19', thereby camming dogs 19' into engagement with grooved profile 15 on wellhead housing 13. Connector 11' of the horizontal tree is now connected to wellhead housing 13 of the subsea well.

Under normal operating conditions the hydraulic fluid is transmitted into lower piston chamber 39' in order to build enough pressure to move piston 23' axially upward relative to dogs 19'. As piston 23' moves axially upward, inclined face 25 slides out of engagement with the outer surface of dogs 19' thereby allowing dogs 19' to expand radially outward out of engagement with grooved profile 15, thereby unlocking connector 11' from wellhead housing 13. In the event that one of lower seals 33 or 37 becomes damaged or inoperable, piston 23' must be actuated from its axial downward position to its axial upward position through a secondary means. In the prior art, override plate 43 would be actuated upward in order to pull piston 23 from its lower to its upper position. In this embodiment as shown in FIG. 2, an operator transmits a hydraulic fluid through piping connector 49 and rod passage 47 into piston passage 51 to override chamber 57. Hydraulic pressure increases in override chamber 57 to create a force that moves piston 23' relative to secondary piston 53. Because secondary piston 53 and piston 23' are initially in their lowered position, the lower surface of secondary piston 53 is preferably engaging an upper surface of receiving portion 17', thereby forcing piston 23' to move axially upward as the pressure inside override chamber 57 increases. As piston 23' moves axially upward dogs 19' are moved out of engagement from grooved profile 15 in the manner described above.

Figure 3:
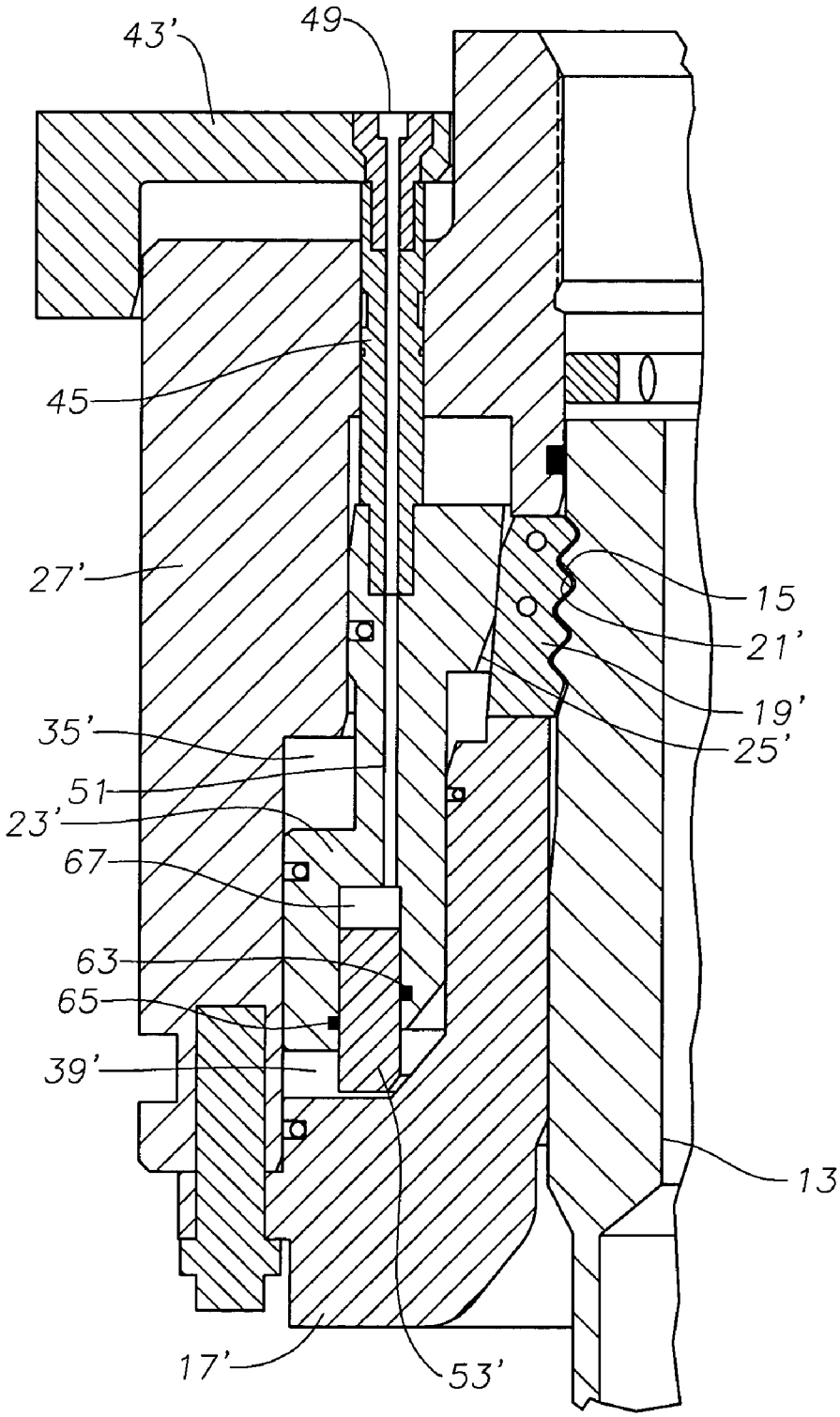
FIG. 3 is an alternative embodiment of the connector assembly shown in FIG. 2.

Referring to FIG. 3, in an alternative embodiment, seals 55 shown in FIG. 2 located on secondary piston 53 are removed. In the embodiment shown in FIG. 3 an inner seal 63 is located along a radially inward surface that engages secondary piston 53'. An outer seal 65 is located along a radially outward surface that also engages secondary piston 53'. Inner seal and outer seal 63 and 65 define an override chamber 67. Override chamber 67 performs substantially the same function as override chamber 57 shown in FIG. 2.

In operation, connector assembly 11' operates substantially the same in FIG. 3 as the embodiment shown in FIG. 2 with the exception that inner seal 63 and 65 are positioned on piston 23' rather than on secondary piston 53'.

Figure 4:
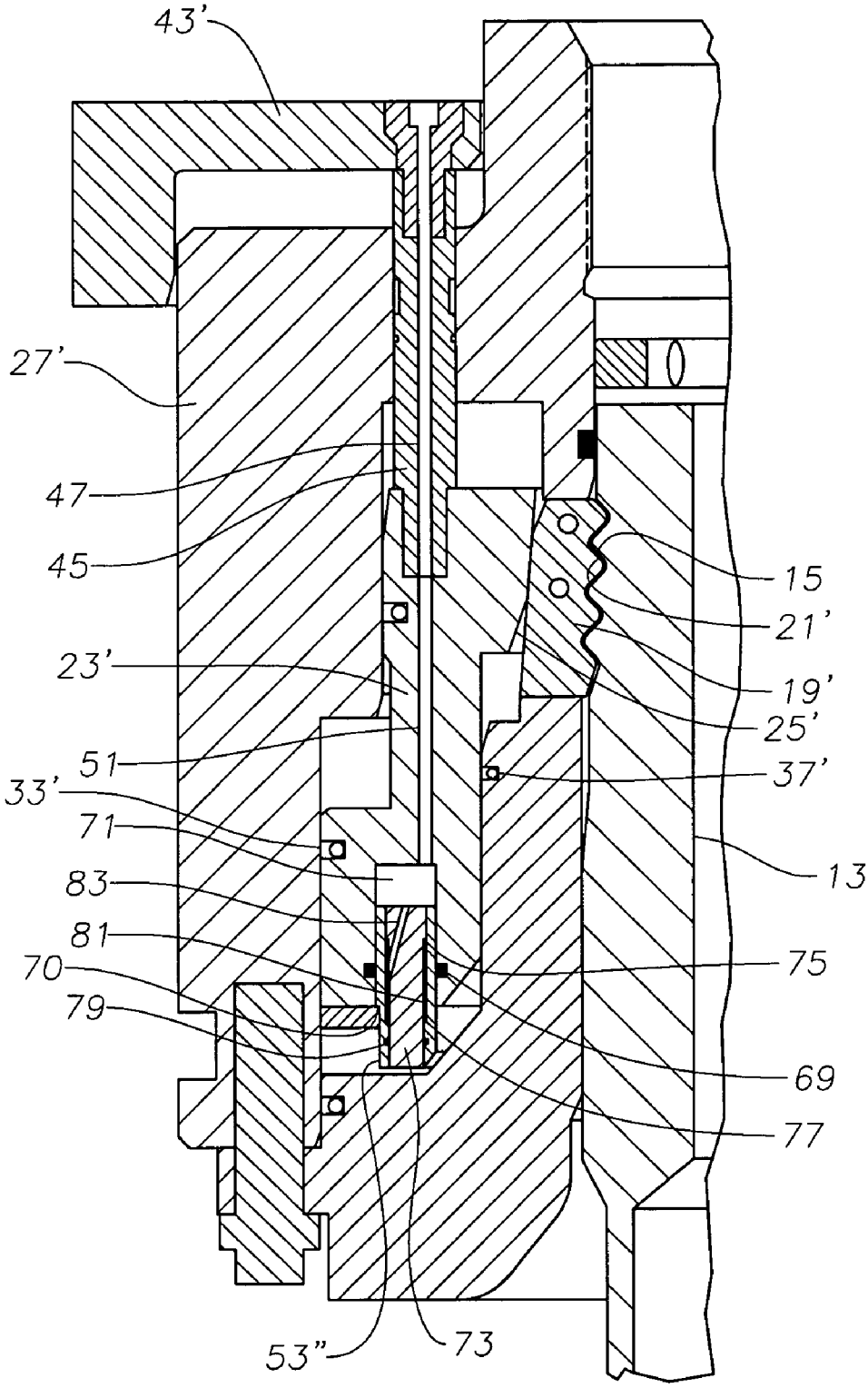
FIG. 4 is another alternative embodiment of the connector assembly shown in FIG. 2.

Referring to FIG. 4, another alternative embodiment is shown for a secondary piston 53". In this embodiment secondary piston 53" engages seal 69 located on radially inward and radially outward surfaces of piston 23'. Seal 69 and piston 53" define an override chamber 71 that receives hydraulic fluid to actuate secondary piston 53" in substantially the same manner as the embodiments discussed above. Piston 53" also preferably includes a second stage piston 73 located radially between the inner and outer surfaces of secondary piston 53". Second stage piston 73 moves axially upward and downward relative to the remaining portion of secondary piston 53".

In this embodiment, a pair of lips 75 are preferably formed toward an upper portion of second stage piston 73 for limiting the axial movement of second stage piston 73 relative to secondary piston 53". In this embodiment, a pair of shoulders 77 formed on the interior surfaces of second piston 53" engage second stage piston 73 to provide a mechanical barrier to second stage piston 73 sliding relative to secondary piston 53" beyond an axial elevation when lips 75 engage shoulders 77. In this embodiment, seals 79 are located on the interior surfaces of secondary piston 53" that engage second stage piston 73. In this embodiment seals 79 are axially located below shoulders 77, thereby defining an annulus 81 between lips 75 and shoulders 77. In this embodiment, a second stage passage 83 extends from the axial upper surface of second stage piston 73 to annulus 81. Second stage passage 83 preferably transmits hydraulic fluid from override chamber 71 to annulus 81 during operation.

In operation, connector assembly 11' and piston 23 engage wellhead housing 13 as described above. In the event that seals 33' and 37' fail, operator uses secondary piston 53" to slide piston 23' axially upward and out of engagement with dogs 19' to unlock connector 11' from wellhead housing 13. In some situations, piston 23' needs to be forced axially upward along a greater stroke length than the stroke of secondary piston 53, 53' in FIGS. 2 and 3 allows. Accordingly, when a longer stroke is desired, operator utilizes secondary piston 53" shown in FIG. 4. The hydraulic fluid is transmitted through rod passage 47 of override rod 45 through piping connector 49 and piston passage 51 to override chamber 71. As fluid pressure inside override chamber 71 increases piston 23' is forced axially upward relative to secondary piston 53" as described above. Second stage passage 83 transmits hydraulic fluid to annulus 81 surrounding second stage piston 73 to balance the hydraulic pressure in annulus 81 with override chamber 71, so that second stage piston 73 does not initially move relative to the remaining portion of secondary piston 53". A shoulder 70 is located along the inner surface of piston 23' that engages the outer surface of secondary piston 53". After piston 23' slides axially upward a preselected distance so that the outer portion of secondary piston engages shoulder 70 of piston 23', the hydraulic pressure inside override chamber 71 continues to force piston 23' to move relative to second stage piston 73. Second stage passage 83 allows any hydraulic fluid in annulus 81 to flow back into override chamber 71 as second stage piston 73 slides axially downward relative to the remaining portion of secondary piston 53". As piston 23' and secondary piston 53' slide axially upward relative to second stage piston 73, piston 23' continues to slide out of engagement with the outer surface of dogs 19' so that dogs 19' can disengage from wellhead housing 13.

Figure 5:
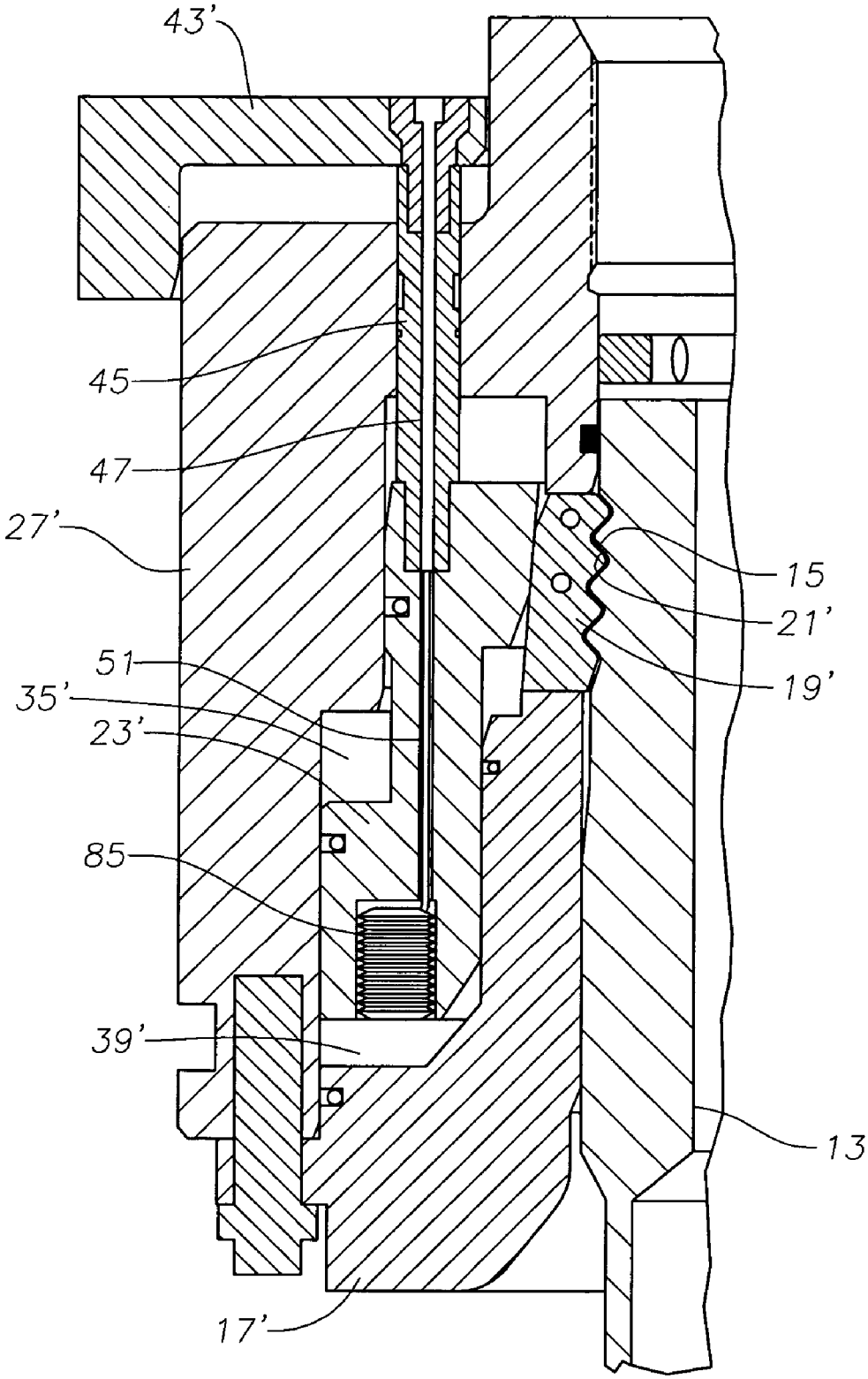
FIG. 5 is another alternative embodiment of the wellhead connector assembly shown in FIG. 2.

Referring to FIG. 5, in another alternative embodiment secondary pistons 53, 53', 53" are replaced by a bellow 85. In this alternative embodiment, bellow 85 can be positioned within piston 23' so that it moves with piston 23' as connector assembly 11' locks with wellhead housing 13. Alternatively, bellow 85 can be positioned on receiving portion 17' and is received by piston 23' as connector 11' locks into engagement with wellhead housing 13. In operation, an operator needing to unlock connector 11' from wellhead housing 13 after a seal failure, injects hydraulic fluid through rod passage 41 and piston passage 51 into bellow 85. Upon receiving hydraulic fluid inside of bellow 85, bellow 85 expands a preselected length to force piston 23' axially upward. Upon expanding the preselected length, piston 23' has moved so that dogs 19' expand radially outward and out of engagement from wellhead housing 13, and connector assembly 11' is disengaged.

In all of the embodiments discussed above, the backup unlocking system (the secondary piston or the bellow) is housed within the connector. This reduces the amount of space previously required for backup unlocking assemblies like external pistons. Additionally, unlike the external pistons, the connector rods do not experience the forces associated with unlocking the connector through the backup system. Rather, the main piston, the upper surface of the receiving portion, and either the secondary piston or bellow experience the additional forces. This reduces the need for stronger or larger connection rods.

While the invention has been shown in only some of its forms, it should be apparent to those skilled in the art that it is not so limited, but is susceptible to various changes without departing from the scope of the invention. For example, in all the embodiments shown, secondary piston 53 has been shown as a member that moves with piston 23' as main piston 23 moves into its locked position. Alternatively, secondary piston 53 could be rigidly attached to the outer surface of receiving portion 17 so that main piston 23 receives secondary piston 53 upon moving into its axially lower position.

That claimed is:

1. A subsea wellhead assembly, comprising:

a tubular wellhead member;

a connector for a tree assembly that receives an axially upper portion of the tubular wellhead member, the connector having a plurality of locking members that actuate radially inward and outward between locked and unlocked positions;

a main piston housed within the connector for actuating the plurality of locking members with the wellhead member; and a chamber located in a lower portion of the main piston when the main piston is in its axially downward position, the chamber being defined by a secondary piston that sealingly engages an annulus formed in the lower portion of the main piston, the chamber exerting an axially upward force on the main piston upon receiving a fluid for actuating the locking dogs to the unlocked position.

2. The subsea wellhead assembly of claim 1, further comprising a passage formed through the main piston for transmitting the fluid from a fluid source.

3. The subsea wellhead assembly of claim 1, wherein the secondary piston has an outer portion and a telescoping portion, the outer portion slidingly engages the main piston after the chamber receives the fluid, and the telescoping portion extends from the outer portion after the outer portion stops sliding relative to the main piston.

4. The subsea wellhead assembly of claim 1, wherein the main piston further comprises a mechanical guide positioned radially outward of a portion of the secondary piston; and the secondary piston further comprises a downward facing lip that engages the mechanical guide when the secondary piston extends from the lower portion of the main piston.

5. A subsea wellhead assembly, comprising:

a tubular wellhead member;

a connector for a tree assembly that receives an axially upper portion of the tubular wellhead member, the connector having a plurality of locking members that actuate radially inward and outward between locked and unlocked positions;

a main piston housed within the connector for actuating the plurality of locking members with the wellhead member; and a chamber located in a lower portion of the main piston when the main piston is in its axially downward position, the chamber exerting an axially upward force on the main piston upon receiving a fluid for actuating the locking dogs to the unlocked position, the chamber is defined by a bellow located within the main piston which expands upon receiving the fluid.

6. The subsea wellhead assembly of claim 5, further comprising a passage formed through the main piston for transmitting the fluid from a fluid source.

7. A subsea wellhead assembly, comprising:

a tubular wellhead member;

a connector for a tree assembly that receives an axially upper portion of the tubular wellhead member, the connector having a plurality of locking members that actuate radially inward and outward between locked and unlocked positions;

a main piston housed within the connector for actuating the plurality of locking members with the wellhead member;

a chamber located in a lower portion of the main piston when the main piston is in its axially downward position, the chamber exerting an axially upward force on the main piston upon receiving a fluid for actuating the locking dogs to the unlocked position; and a secondary piston located with the lower portion of the main piston that sealingly engages an annulus formed in the lower portion of the main piston, secondary piston has an outer portion and a telescoping portion, the outer portion slidingly engages the main piston after the chamber receives the fluid, and the telescoping portion extends from the outer portion after the outer portion stops sliding relative to the main piston.

8. The subsea wellhead assembly of claim 7, further comprising a first passage formed through the main piston for transmitting the fluid from a fluid source and a second passage formed through the telescoping portion of the secondary piston which is in fluid communication with an interior surface of the outer portion of the secondary piston.

* * * * *

UNITED STATES PATENT AND TRADEMARK OFFICE

CERTIFICATE OF CORRECTION

PATENT NO. : 6,966,382 B2
DATED : November 22, 2005
INVENTOR(S) : Kevin G. Buckle et al.

It is certified that error appears in the above-identified patent and that said Letters Patent is hereby corrected as shown below:

Column 1,
Line 39, delete “actuated” and insert -- actuate --.

Column 2,
Lines 47, 50 and 61, delete “group” and insert -- grooved --.

Column 3,
Lines 8 and 15, delete “defining” and insert -- define --.
Line 28, delete “in” and insert -- an --.

Column 4,
Line 7, delete “group” and insert -- grooved --.

Column 6,
Line 45, delete “dogs” and insert -- members --.

Column 7,
Line 11, delete “dogs” and insert -- members --; and insert -- wherein -- after “position,”.

Column 8,
Line 8, delete “dogs” and insert -- members --.

Signed and Sealed this

Fourth Day of April, 2006

JON W. DUDAS
*Director of the United States Patent and Trademark Office*